US009823007B2

(12) United States Patent
Cheng et al.

(10) Patent No.: US 9,823,007 B2
(45) Date of Patent: Nov. 21, 2017

(54) BEVERAGE CONTAINER CHILLING APPARATUS AND METHOD

(71) Applicant: Meyer Intellectual Properties Ltd., Kowloon (HK)

(72) Inventors: Stanley Kin Sui Cheng, Hillsborough, CA (US); Edward S Sherman, Santa Rosa, CA (US)

(73) Assignee: Meyer Intellectual Properties Limited (VG)

( * ) Notice: Subject to any disclaimer, the term of this patent is extended or adjusted under 35 U.S.C. 154(b) by 279 days.

(21) Appl. No.: 14/662,076

(22) Filed: Mar. 18, 2015

(65) Prior Publication Data

US 2016/0273829 A1 Sep. 22, 2016

(51) Int. Cl.
*F25D 3/08* (2006.01)
*A47G 23/02* (2006.01)

(52) U.S. Cl.
CPC ..... *F25D 3/08* (2013.01); *A47G 23/0241* (2013.01); *F25D 2303/081* (2013.01); *F25D 2303/0841* (2013.01); *F25D 2331/803* (2013.01); *F25D 2331/809* (2013.01)

(58) Field of Classification Search
CPC ..... F25D 3/08; F25D 2303/081; F25D 2303/0841; F25D 2331/803; F25D 2331/809; F25D 31/007; F25D 2331/8051; A47G 23/0241
USPC ..... 62/62
See application file for complete search history.

(56) References Cited

U.S. PATENT DOCUMENTS 592,781 A * 11/1897 Hertwig ..... A47G 23/0241 220/324
1,186,418 A * 6/1916 Mischo ..... F25D 3/08 62/331
1,999,670 A * 4/1935 Strouse ..... F25D 3/14 220/592.16
2,168,969 A * 8/1939 Bickerstaff ..... F25D 3/08 215/10
2,194,719 A * 3/1940 Parrish ..... A23G 9/106 220/592.13
2,838,916 A * 6/1958 Planes Y Sola ..... F25D 31/008 62/336
4,163,374 A * 8/1979 Moore ..... B65D 81/3883 220/592.01
4,232,532 A * 11/1980 Marsh ..... B65D 81/3883 220/592.28
4,638,645 A * 1/1987 Simila ..... F25D 3/08 62/371
4,823,974 A * 4/1989 Crosser ..... A47G 19/2288 206/545
4,923,086 A * 5/1990 Mahon ..... A47F 3/0486 220/676
5,201,194 A * 4/1993 Flynn, Jr. ..... A47G 23/04 62/457.2
5,862,937 A * 1/1999 Carrizales ..... F25D 31/007 206/5

(Continued)

*Primary Examiner* — Emmanuel Duke
(74) *Attorney, Agent, or Firm* — Edward S. Sherman

(57) ABSTRACT

A vessel for chilling wine with ice or ice-water mixture has an inner support chamber for standing up wine bottle and separating them from liquid water to avoid over chilling. The inner support as a plurality of perforations in an upper portion of the vessel to facilitate heat exchange. As ice outside the support melts, the water formed will remain below the perforations.

16 Claims, 8 Drawing Sheets

(56) References Cited

U.S. PATENT DOCUMENTS

| | | | | |
|---|---|---|---|---|
| 6,168,043 | B1 * | 1/2001 | Yen | A47G 23/0241 220/501 |
| 6,237,360 | B1 * | 5/2001 | Corona | A47G 23/0241 62/457.4 |
| 6,314,751 | B1 * | 11/2001 | Gjersvik | F25D 3/02 62/372 |
| 7,370,492 | B2 * | 5/2008 | Hoare | F25D 3/08 62/457.8 |
| 2015/0061484 | A1 * | 3/2015 | Jeong | F25C 5/005 312/404 |

* cited by examiner

BEVERAGE CONTAINER CHILLING APPARATUS AND METHOD

CROSS REFERENCE TO RELATED APPLICATIONS

None

BACKGROUND OF INVENTION

The present invention relates to an apparatus and method for chilling bottles, and more particularly still or sparkling wine bottles.

Prior methods of chilling wine bottles deploy a container filled with either ice or ice water. The temperature of the bottle contents eventually comes to equilibrium with the ice or ice water temperature. A large volume of ice or ice water is used to chill the wine rapidly. While it is desirable to serve white wines in a temperature range of about 42° F. to about 55° F., the more ice or ice water used to chill the bottle quickly, the more likely the wine is to be too cold, that is between about 36° to 32° F. toward the end of a meal.

It is therefore a first object of the present invention to provide a superior method and apparatus for chilling beverages, including wine bottles . . . .

It is another object of the invention to provide an apparatus and method for cooling wine with ice or cold water that does overly chill beverage, yet keeps them cold and within a desired temperature range for table use over many hours.

It is another object of the invention to provide such an apparatus for use in an improved method which is adaptable to different size beverage container.

SUMMARY OF INVENTION

In the present invention, the first object is achieved by providing a container, comprising a vessel capable of retaining a fluid have a bottom and substantially upright sidewalls connected to and surrounding the bottom, the sidewall having an upward termination at the rim of the vessel, wherein the improvement consists of an inner cylindrical support member attached to an interior bottom of the vessel, and having a plurality of spaced apart perforation that extend upward from about half the height of the vessel to an upper rim of the inner cylinder.

A second aspect of the invention is characterized in that the vessel has doubles walls, and/or handles and a lid.

A third aspect of the invention is providing a cylindrical form with perforation on an upper portion thereof, for attachment to the inside of a vessel.

The above and other objects, effects, features, and advantages of the present invention will become more apparent from the following description of the embodiments thereof taken in conjunction with the accompanying drawings.

DETAILED DESCRIPTION

Figure 1:
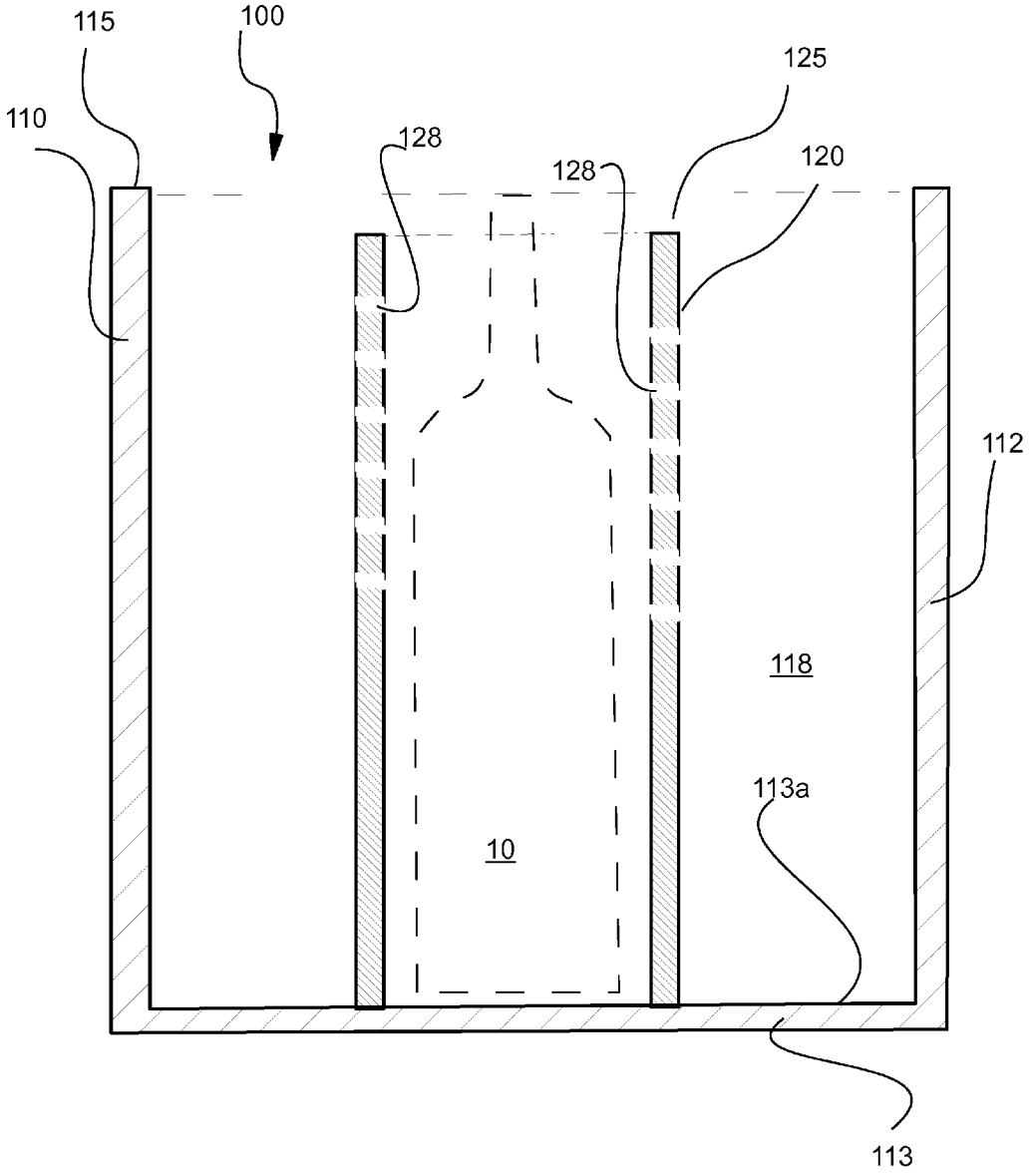
FIG. 1 is a cross-sectional elevation of a first embodiment of the invention.

Referring to FIGS. 1 through 8, wherein like reference numerals refer to like components in the various views, there is illustrated therein a new and improved Bottle Chilling Container and Method, generally denominated 100 herein.

In accordance with the present invention, bottle chilling apparatus 100 comprises an outer container or vessel 110 and an inner column 120. The inner column 120 is preferably perforated in an upper portion below the rim 125 with a plurality of holes 128. The rim 125 of the inner column preferably extends upward to about the same height or just below the outer containers rim 115. The inner column is a preferably an inner cylindrical support member attached to an interior bottom of the vessel, and preferably has a plurality of spaced apart perforation on an upper portion of the columns upright walls.

Figure 2:
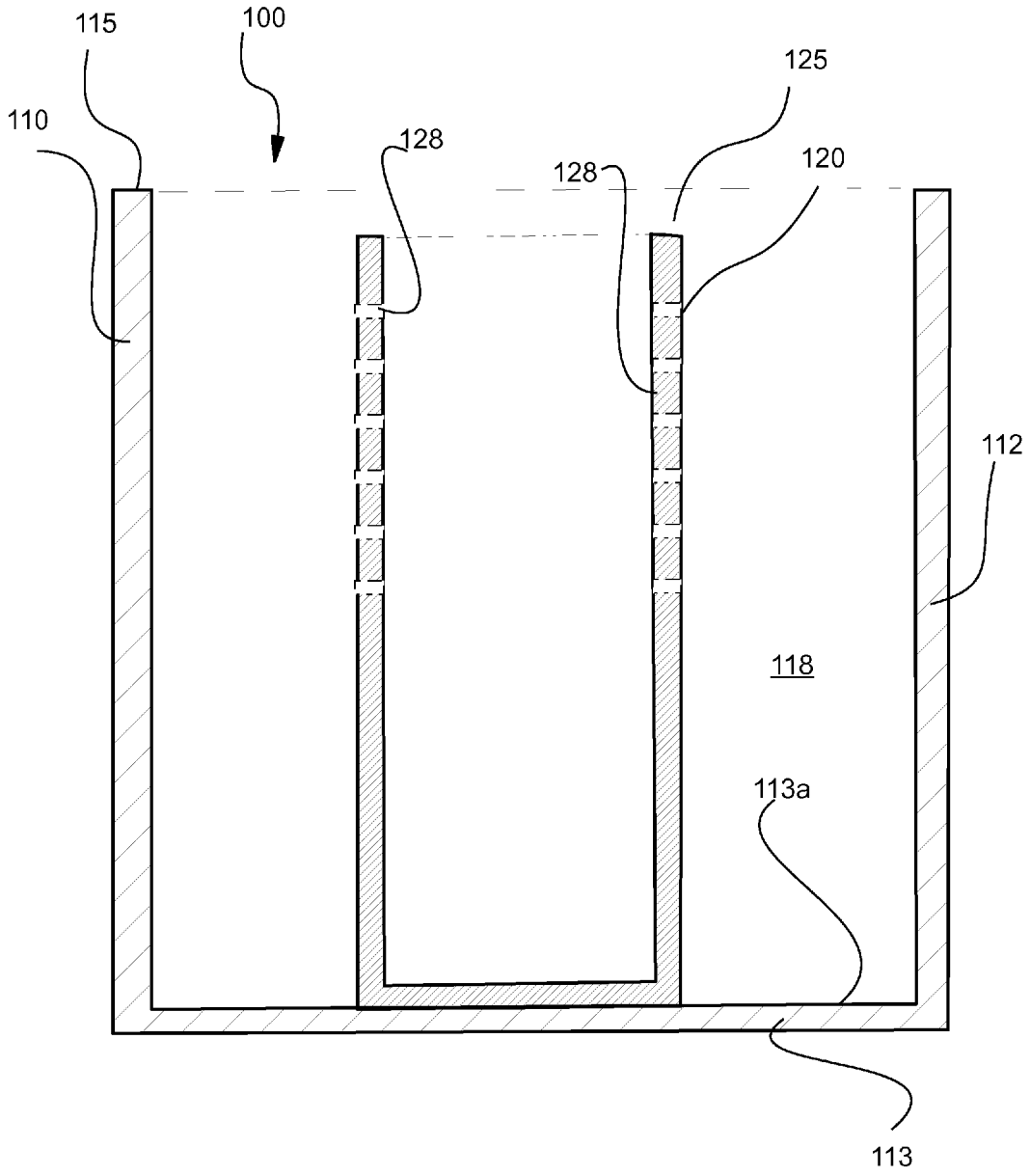
FIG. 2 is a cross-sectional elevation of another embodiment of the invention.
Figure 3:
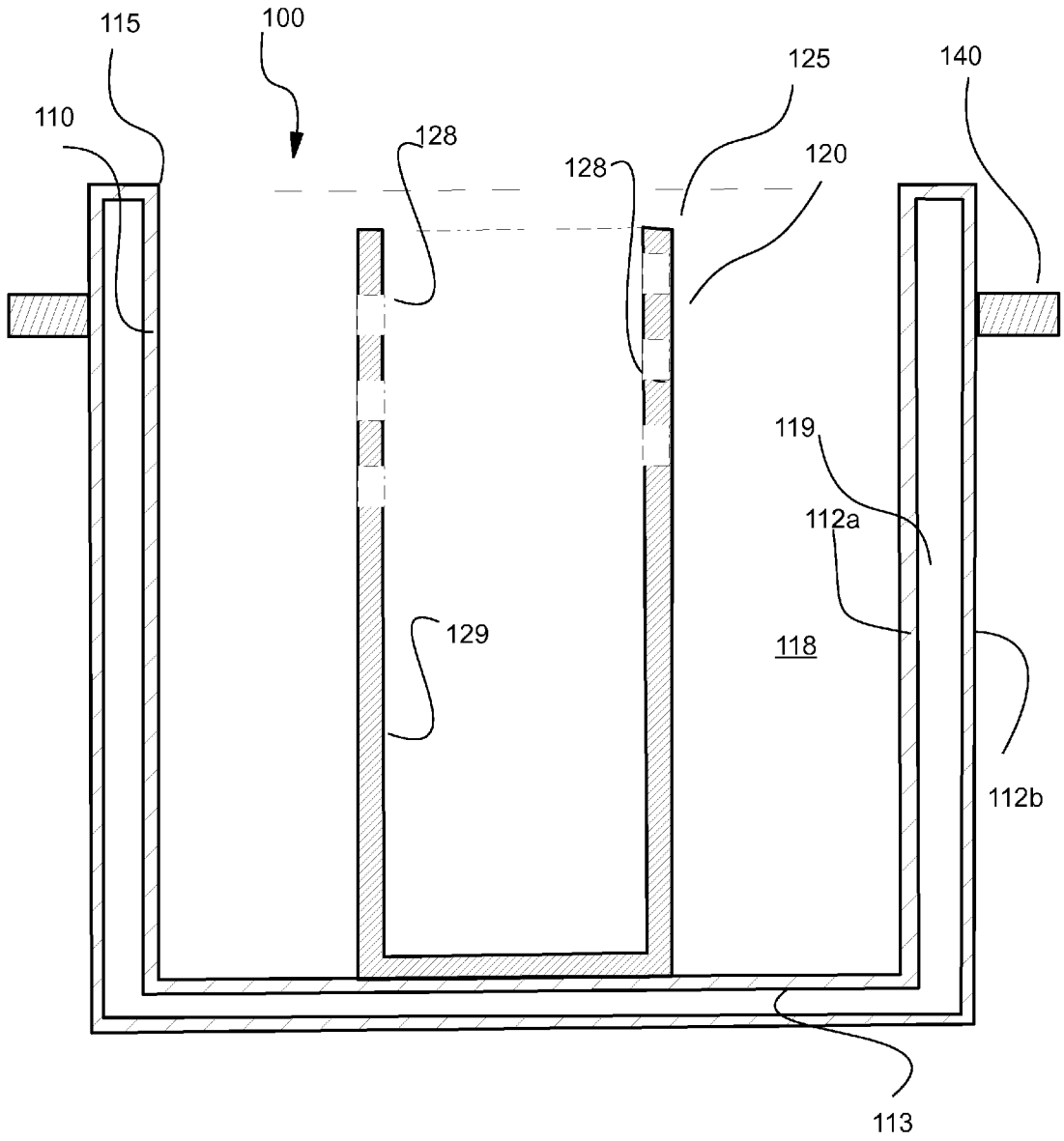
FIG. 3 is a cross-sectional elevation of another embodiment of the invention.

The container 100 is used to chill or maintain the temperature of beverage bottles, especially wine and champagne. The inner column 120 is optionally another fluid retaining container bonded at the exterior bottom thereof to the interior bottom 113*a* of the outer container 110, as shown in FIG. 2. Starting the perforation 128 at about ⅓ to ½ the height of the bottle 10 allow the lower portion of cavity 118 outside the sealed column 120 to fill with ice water or a slush of ice and water and either preclude or delay the flow of this liquid can flow into the inner column through the holes 128. In other words, in the process of use, a wine bottle (or other beverage container) is placed in and supported by the inner column 120; the outer cavity is filled with ice to the rim 115 of the outer container or vessel. As the ice chills the bottle it melts, but because of interstices between sold ice chunks and shrinkage on melting, the resulting water remains below the lowest hole 128 and this very cold, near 32 F water does not enter the column 120 and make direct contact with the bottle 10. However, if desired, a small quantity of water can be poured into column 120 and ice or an ice-water mixture placed in cavity 118.

In use, as shown in FIG. 1, a bottle or beverage container 10 is inserted into the inner column 120 and ice and optionally some water is placed in the annular cavity 118 formed between the inner upright wall 112 of the outer container 110 and the exterior of the inner column 120. Ice and optionally ice and some water are placed in cavity 118.

While the bottle container for chilling 100 is preferably deployed to chill wine and champagne container, preferably wine and champagne bottles, it is applicable to other beverage, such as apple cider, hard cider, perry, beer, mead, which may or may not be artificially or naturally carbonated, as well as non-alcoholic beverages.

While most beverage containers are cylindrical, the apparatus can be readily adapted to accommodate a range of container shapes, such as rectangular container, and depending on the size of the inner column, to accommodate both cylindrical and non-cylindrical containers of different sizes.

Hence, the reference to bottles is not limited to any particular size or shape beverage container absent further express limitations.

The holes 128 provide a means for conduction to chill the bottle 10, which will also chill slowly due to loss of heat to the cold inner wall 129 of the column 120. The inner wall 129 of the column 120 is cooled by direct conduction and radiation from the ice or ice water mixture. However, the solid nature of the column below holes 128 precludes ice water, such as will be formed as ice melts, from directly contacting the wine in the bottle 10. Hence, wine if pre-chilled will easily be maintained in the temperature range of about 41° to 52° F. for many hours, depending on the ambient temperature. If the wine bottle is warmer, it will also chill, but more slowly. By avoiding direct contact of the ice water and/or slush with the bottle, chilling is much slower to avoid the beverage container content from approaching the slush temperature of circa 32° F. It should be understood below about 40°, further chilling is generally undesirable from taste, aroma and flavor perception. However, as this threshold is subject to personnel and regional tastes, the device 100 can be configured with more or larges holes 128, or lower holes 128 (that is the lowest holes on column 120 are closer to the bottom of the container 110) to allow colder chilling and/or establish a colder minimum temperature that will be reached.

The inner column 120 is preferably round in cross-section and has a diameter slightly larger than a standard champagne or sparkling wine bottle, or optionally champagne or sparkling wine magnum so that it can receive and hold upright bottles ranging in size from a relatively narrow bottle for 750 ml of wine to a wider magnum bottle holding approximately 1.5 L. The inner container also prevents the bottle 10 from tipping over, as can occur in a wine ice bucket as it becomes empty.

Red and rose wines can also be chilled slightly from 66° F. to about 54° F. and/or maintained at this temperature depending on the quantity of ice and or/ice water placed in the annular cavity 118. It should be appreciated that while an ice water mixture that forms in the cavity 118 will approach 32° F., the wine in the inner container 120 will avoid being cooled to below a desired serving temperature for many hours.

In a more preferred embodiment shown in FIG. 2-6, the outer container has insulated walls and more preferably a double wall construction (in which air between the walls provides insulation) to prevent heat transfer to the ice in the container 110 which would hasten the melting of the ice. It is also preferred that the outer container have handles 140, as shown in FIG. 3-6.

Figure 4:
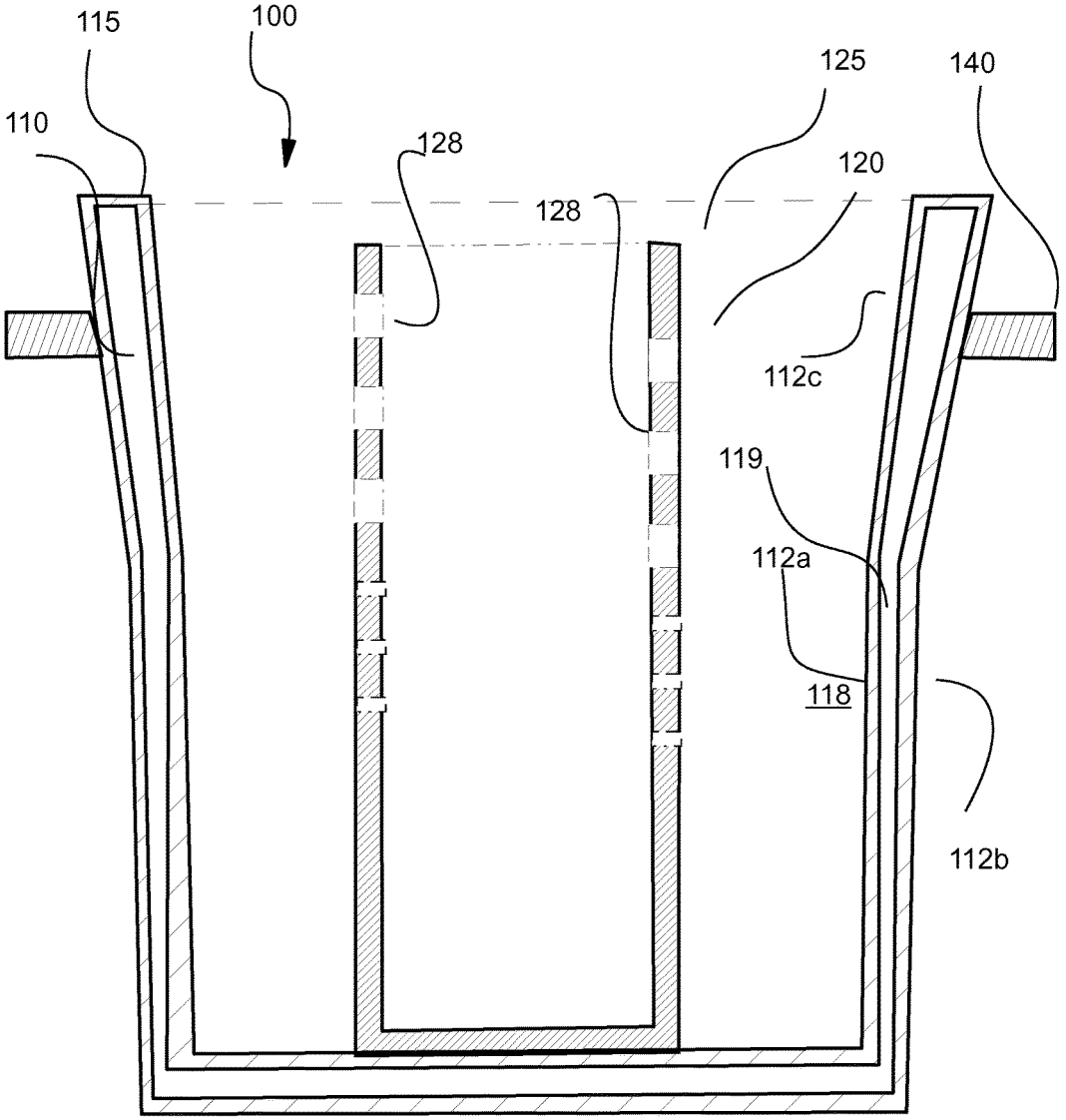
FIG. 4 is a cross-sectional elevation of another embodiment of the invention.

As shown in FIG. 4, in another embodiment, the outer container preferably has an inverted frustro-conical inner wall 112*c* in at least an upper portion for ease of adding ice to a wider opening at the rim 115, than at the lower wall portion 112*b*.

Figure 5:
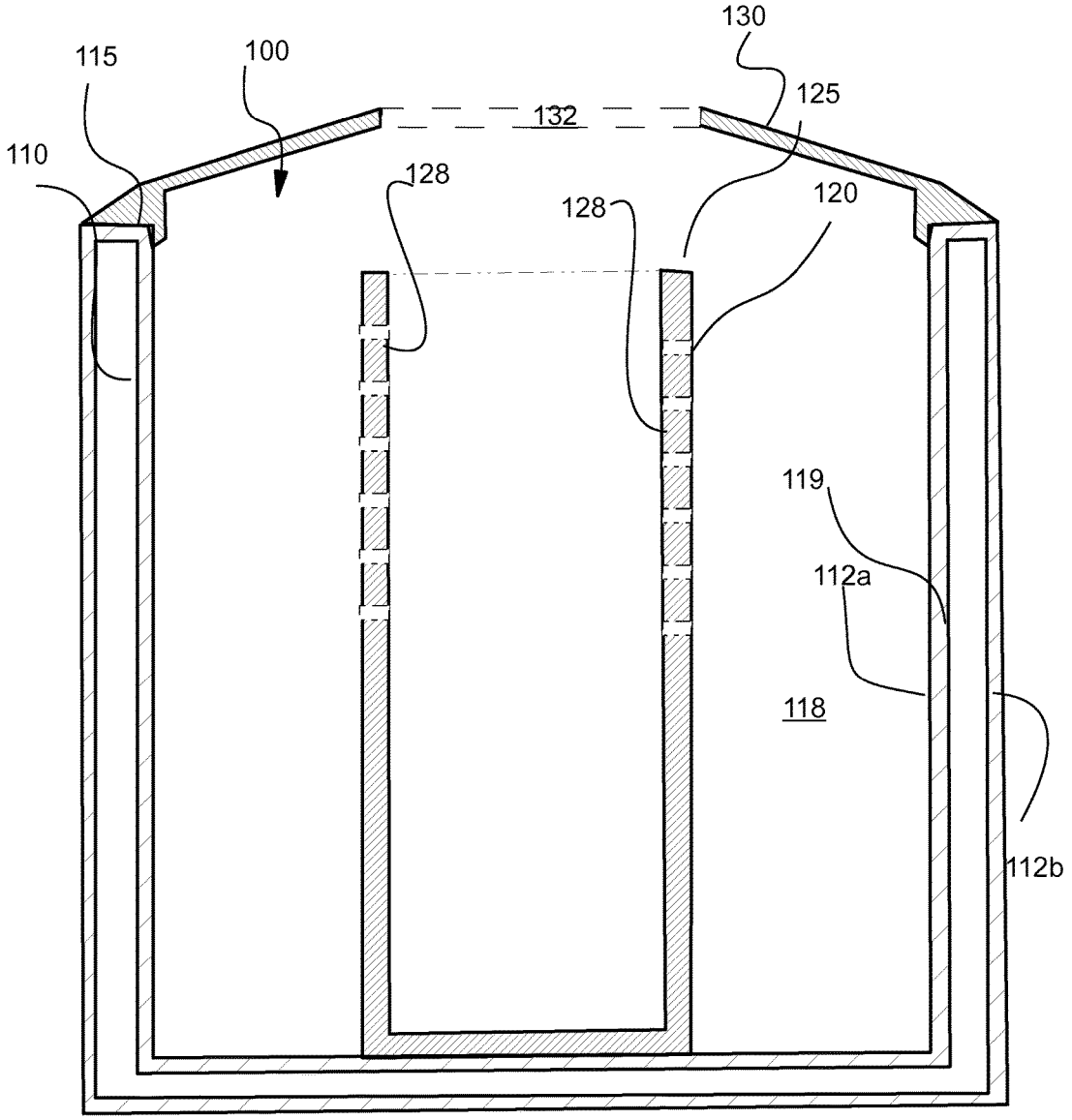
FIG. 5 is a cross-sectional elevation of another embodiment of the invention.
Figure 6:
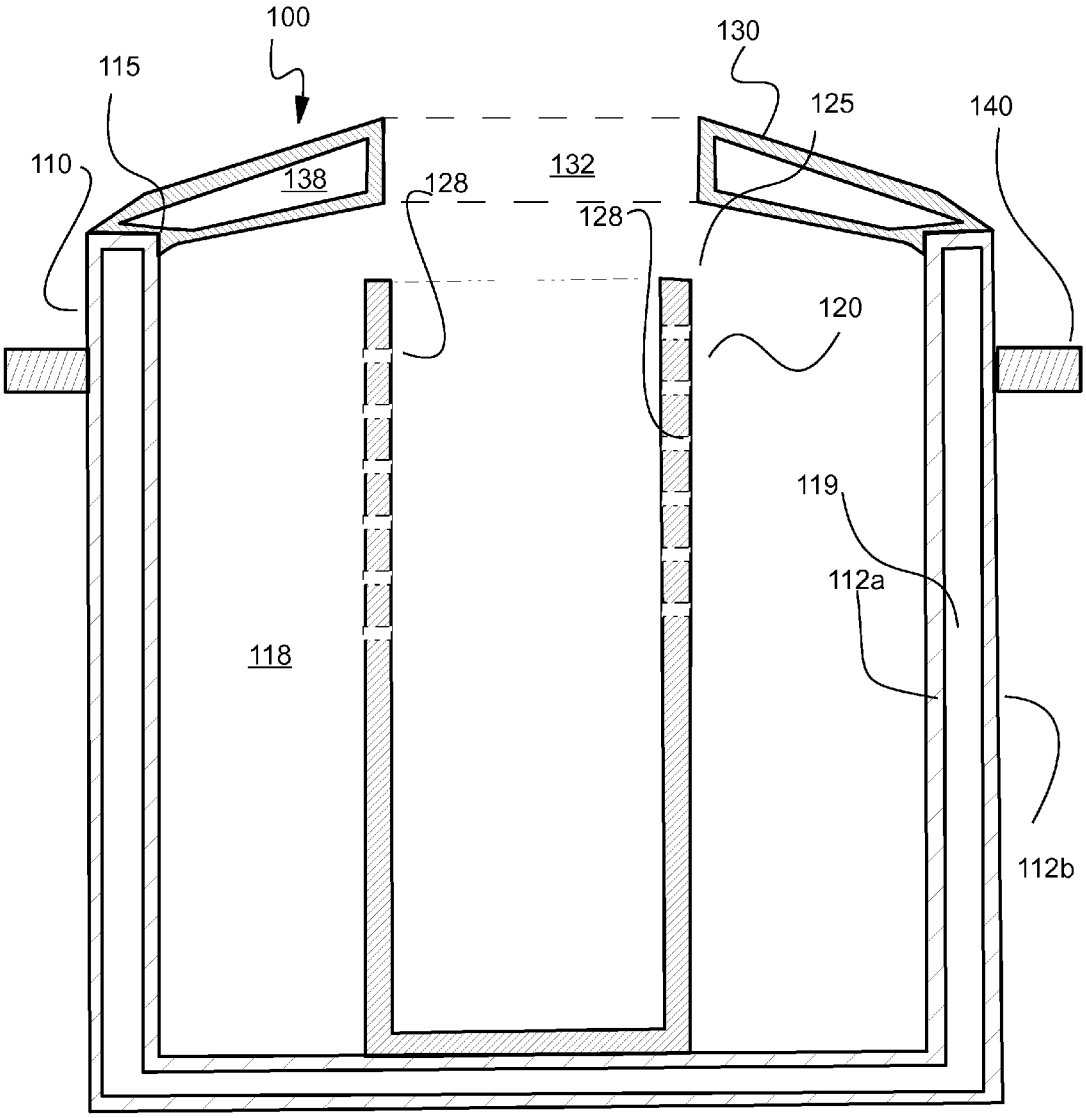
FIG. 6 is a cross-sectional elevation of another embodiment of the invention.
Figure 7A:
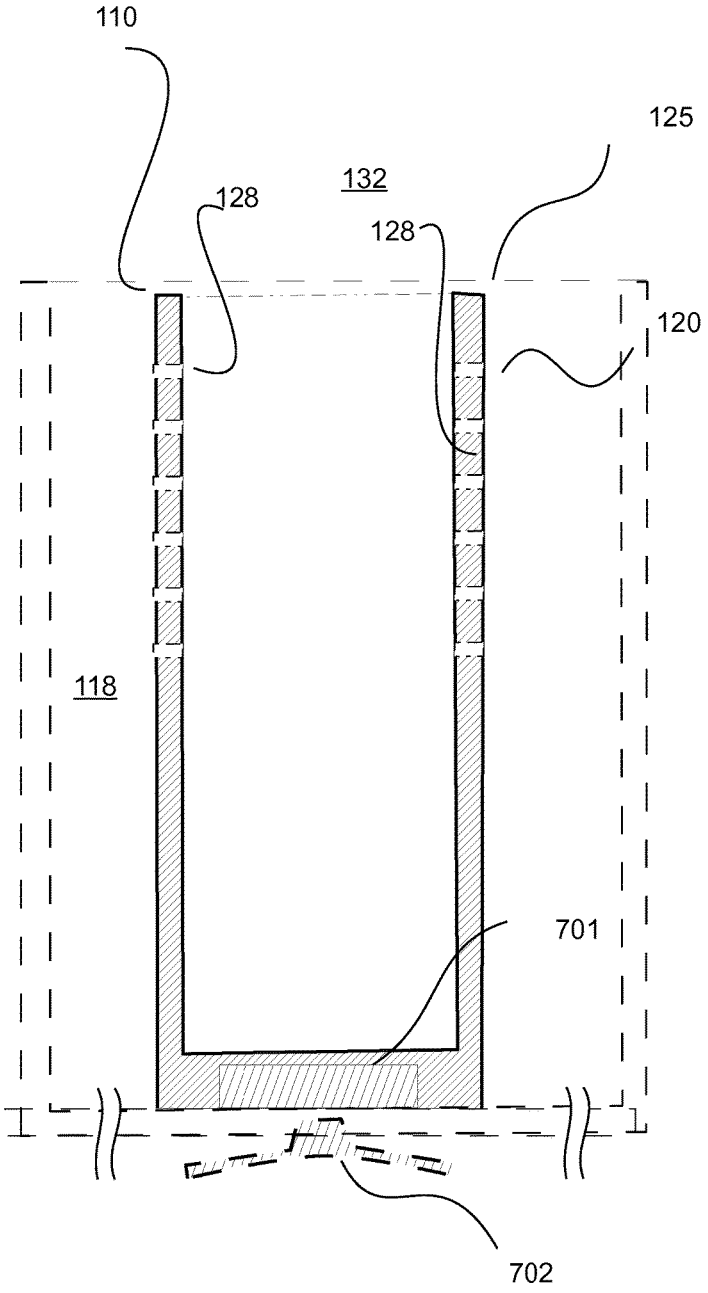
FIG. 7A is a cross-sectional elevation of another embodiment of the invention.
Figure 7B:
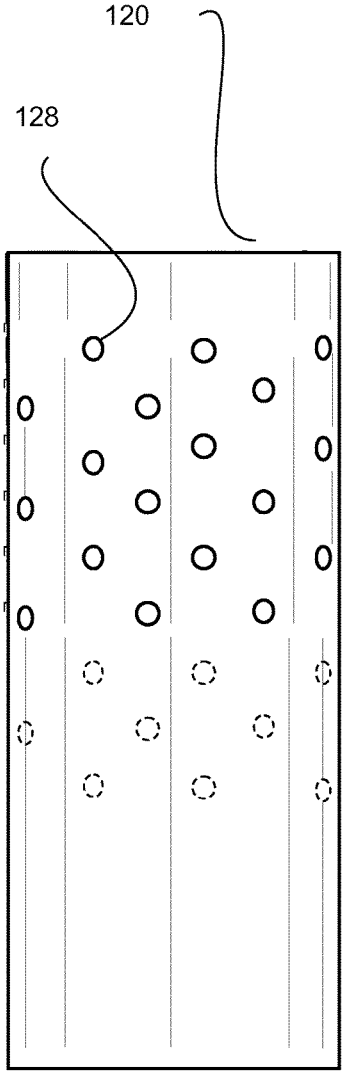
FIG. 7B is an exterior elevation view of the interior portion of the container.
Figure 8A:
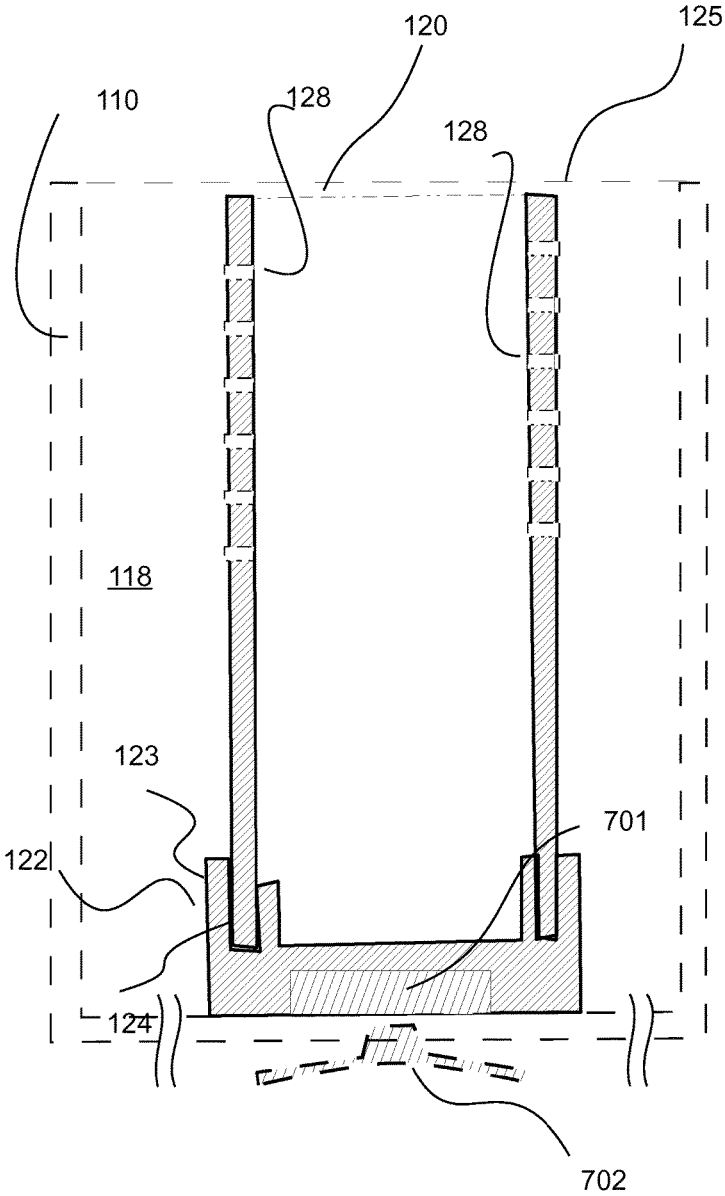
FIG. 8A is a cross-sectional elevation of another embodiment of the invention.
Figure 8B:
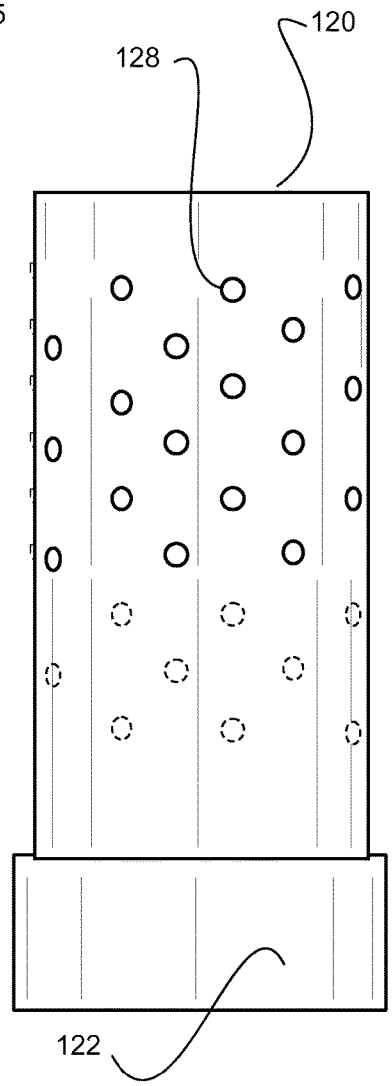
FIG. 8B is an exterior elevation view of the interior portion of the container.

As shown in FIG. 5-6, it is also preferred to provide a lid 130 with a central aperture 132 for the upper portion of the wine bottle 10 to freely extend upward. The lid 130 further preclude melting of the ice, and more absorption of heat from a warmer bottle, extending the serving time or provide more rapid initial chilling. In FIG. 6, lid 130 is itself insulated with an inner annular cavity 138. The lid is intended to space the open top of the container 110 along the perimeter of the rim FIGS. 7 and 8 illustrates embodiment in which a central column 120 as described above can be adding to or detached from an existing outer container 110. In FIG. 7, the central column 120 is an integrated vessel with a bottom portion that removably attaches to the interior of an outer container via an embedded magnetic 701 or suction cup 702, or combination thereof. A similar structured central column 120 can also be permanently attached to the outer container 110 to provide the functional equivalent of the first embodiment of the container 100 in FIG. 1.

In FIG. 8, the container 120 is formed by a bottom cup that is intended to receive a cylindrical wall. The bottom cup 122, likewise as in FIG. 7, deploys either an embedded magnet 701 or suction cup 702 to attach to the interior vessel. The wall 123 has an inner channel 124 to receive the wall of the cylindrical tube 121. A rubber seal, gasket or o-ring may be deployed in the recess of cup wall to provide a fluid type seal. Alternatively the portion of the wall 128 that is inserted in the cup may have a rubber or elastic coating, covering or cladding to form such a seal. The cup itself may be rubber or/an elastic material at least in the wall receiving portion to provide such a barrier to fluid flow.

By providing a detachable inner container 120, the inner container 120 can be removed to accommodate larger beverage containers with the large container 110.

However, as fluid flow is gradual and minimized, the bottle will still not be chilled to too low a temperature. According, the seal between the wall 128 and cup 122 need only be substantial to the extent that the flow of water or slush is lower than it would be without the wall like barrier 128.

The perorations 128 can have size, shape and total open areas so long as the wall 125 is reasonably rigid and not reduced in strength by them. The size, shape and open area can be constant with height, or change with height as in a gradient or abrupt change, such as in FIG. 4. To the extent that the ice shrinks on melting and any interstices between solid ice particles will be filled with fluid, it is desirable that the size of the perforation be smaller than the size of ice cubes, and more preferably crushed ice so that the step of filling the vessel with ice between the inner container and the vessel wall does not inadvertently introduce ice in the lower portion of the inner container. However, to the extent it is desirable to cool a warm or tepid beverage bottle quickly; some ice and or ice water slush can be introduced into the inner container. According the perforation preferable has a diameter or longest width (for non-circular perforations) that is larger than about 1 mm (about $1/25^{th}$ of an inch and smaller than 25 mm (about 1"). The total area of the perforation, within the upper or perforated portion of the wall 128, can be about 10% to 90% of the wall areas, but preferably about 20% to 80% of the wall areas, and more preferably about 30% to 60% of the wall area.

To the extent that the container 100 is intended only to maintain beverage bottles at a cool temperature without further chilling, the inner column 120 need not have many or any holes 128. However, the rim 125 should still preferably extend proximal to the height of the outer container rim 115 to preclude accidental overfilling that unintentionally introduces liquid into the inner column 128.

To the extend it is not intended to provide ice to totally fill the outer container, the height of rim 125 can be lowered considerably such as to about or somewhat below the mid-point of walls 112 of the outer container 110. In such case, it would also be possible to forgoes or use less holes 128 below the rim 125.

The description of a feature, aspect or element of one embodiment of the invention is not intended to not does it preclude its combination with other features, aspects or elements of other embodiments of the invention.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

We claim:

1. A container, comprising: a) a vessel capable of retaining a fluid having a bottom and substantially upright sidewalls connected to and surrounding the bottom, the sidewall having an upward termination at the rim of the vessel, b) an inner support member attached to an interior bottom of the vessel, the inner support member being a wall defining an enclosed volume, the wall having a lower portion and an upper portion in which the lower portion is solid and the upper portion has a plurality of perforation in which the lower portion is the bottom ⅓rd of the height of the inner support member.

2. The container of claim 1 wherein the plurality of spaced apart perforation extend upward to below an upper rim of the inner support member.

3. The container of claim 1 wherein the inner support member is cylindrical in shape.

4. The container of claim 1 wherein the vessel has insulated side walls.

5. The container of claim 1 wherein the inner support member is removable.

6. The container of claims 1 wherein the inner support member engages the bottom of the vessel by magnetic attraction.

7. The container of claim 1 further comprising a lid having a wall and an outer rim for engaging with the rim of the vessel.

8. The container of claim 7 wherein the lid has a central aperture to allow a bottle to extend upward there through.

9. The container of claim 7 wherein the lid wall is insulated.

10. The container of claim 1 wherein the upper portion of the vessel has outward tapering sidewall.

11. The container claim 1 further comprising a lid having an outer rim for engaging with the rim of the vessel.

12. The container of claim 11 wherein the lid has a central aperture to allow a bottle to extend upward there through.

13. The container of claim 11 wherein the lid wall is insulated.

14. The container of claim 13 wherein the upper portion of the vessel has outward tapering sidewall.

15. A method of chilling or maintaining the temperature of a beverage bottle, the method comprising the steps of: a) providing the container according to claim I b) filling a space between the inner support member and the upright walls of the vessel with at least one of ice and a mixture of ice and water, c) inserting a bottle in the inner container.

16. The method of chilling or maintaining the temperature of the beverage bottle according to claim 15 wherein said step of inserting the bottle in the inner container occurs before said step of filling the space between the inner support member and the upright walls of the vessel with the at least one of ice and the mixture of ice and water.

* * * * *